US005942361A

United States Patent [19]

Hoshizaki et al.

[11] Patent Number: 5,942,361

[45] Date of Patent: Aug. 24, 1999

[54] ELECTROPHOTOGRAPHIC PHOTOSENSITIVE MEMBER HAVING S-TYPE PHOTO-INDUCED POTENTIAL DECAY AND ELECTROPHOTOGRAPHIC APPARATUS

[75] Inventors: Taketoshi Hoshizaki; Yasuo Sakaguchi; Yasuhiro Yamaguchi; Ryosaku Igarashi, all of Minami-Ashigara, Japan

[73] Assignee: Fuji Xerox Co., Ltd., Tokyo, Japan

[21] Appl. No.: 08/872,107

[22] Filed: Jun. 10, 1997

[30] Foreign Application Priority Data

Jun. 19, 1996 [JP] Japan ..... 8-158520
Jun. 4, 1997 [JP] Japan ..... 9-146566

[51] Int. Cl.[6] ..... G03G 5/05; G03G 5/047

[52] U.S. Cl. ..... 430/59; 430/58; 430/134; 430/130; 399/159

[58] Field of Search ..... 430/130, 134, 430/58, 59; 399/159

[56] References Cited

U.S. PATENT DOCUMENTS 5,306,586 4/1994 Pai et al. .
5,418,106 5/1995 Snyder, Jr. et al. ..... 430/130
5,654,119 8/1997 Ishii et al. ..... 430/59

FOREIGN PATENT DOCUMENTS 60-158451 8/1985 Japan .
A 1-169454 7/1989 Japan .
1-289956 11/1989 Japan .
A 2-207258 8/1990 Japan .
A 3-31847 2/1991 Japan .
A 5-232727 9/1993 Japan .
A 5-313387 11/1993 Japan .
A 6-83077 3/1994 Japan .
9-96914 4/1997 Japan .

OTHER PUBLICATIONS

Borsenberger, Paul M. & David S. Weiss. Organic Photoreceptors for Imaging Systems. New York: Marcel–Dekker, Inc. pp. 10–11, 1993.
Chemical Abstracts 113:142244, 1989.
Chemical Abstracts 104:43172, 1985.
Weigl et al., "Current Problems in Electrophotography," *Phthalocyanine–Binder Photoreceptors for Xerography*, 1972, pp. 287–299.

*Primary Examiner*—Christopher D. Rodee
*Attorney, Agent, or Firm*—Oliff & Berridge, PLC

[57] ABSTRACT

An electrophotographic photosensitive element having S-type photo-induced potential decay characteristics and an electrophotographic apparatus using the photosensitive member are provided.

The photosensitive member comprises a charge generation layer and a charge transport layer on an electroconductive substrate. The charge transport layer contains a polymer in a phase separated state with a modulated structure, comprising an electrically inactive phase and a charge transporting phase. The amount of exposure required for 50% potential decay is less than 5 times the exposure amount required for 10% potential decay. The modulated structure includes, for example, a mixture of insulating polymer and charge transporting polymer and the like. The modulated structure can be formed by the method of separating a homogeneous phase of these polymers into two phases.

30 Claims, 6 Drawing Sheets

ELECTROPHOTOGRAPHIC PHOTOSENSITIVE MEMBER HAVING S-TYPE PHOTO-INDUCED POTENTIAL DECAY AND ELECTROPHOTOGRAPHIC APPARATUS

BACKGROUND OF THE INVENTION

1. Field of the Invention

The present invention relates to an electrophotographic photosensitive member (photoreceptor) including a charge generation layer and a charge transporting layer on an electroconductive substrate, more particularly, to an electrophotographic photosensitive member suitable for digital photographic methods, and to apparatuses utilizing the said electrophotographic photosensitive member.

2. Description of the Related Art

Over the past few years electrophotographic technology has taken a central role in the world of photocopying, printing, and faxing due to the speed and high quality of the printing obtained.

As is widely known, selenium, selenium tellurium alloys, selenium arsenic alloys and other inorganic photoconductive materials have long been used as electrophotographic photosensitive members in electrophotographic techniques.

However, in terms of cost, productivity, and waste etc., the organic photoconductive materials have excellent advantages over the inorganic based materials. The research in this field has increased to such an extent that now it can be said that the organic photoconductive materials are superior to the inorganic based photosensitive members. In the elementary process of photoconduction, functionally separated layered structures in which the photocharge generation, and charge transport layers are performed in their own separate layers have been developed.

As a result of these structural developments, the breadth of choice of materials has increased and performance has improved remarkably. Organic photosensitive members having functionally separated layered structure organic photosensitive members have become the main photosensitive members of all the electrophotographic photosensitive members.

The charge generation layer for the organic photosensitive members having functionally separated layered structures with pigments capable of generating charge such as quinone pigments, perylene pigments, azo pigments, phthalocyanine pigments, and selenium pigments as well as others have come to be used in practice. The pigments capable of charge generation may be vapor-deposited to form a layer or they may be dispersed in binding resins at high concentration.

At the same time, the charge transport layer is constructed by molecular dispersing low molecular weight compounds such as hydrazone compounds, benzidine compounds, amine compounds, stilbene compounds, and others having charge transporting ability in an insulating resin.

The photoreceptors used by the electrophotographic copying machines in the analogue system, in which an image of an original is focused on the photoreceptor to effect an exposure, need to have good half-tone reproducibility through optical density gradation. In order to achieve satisfactory half-tone reproducibility, a photosensitive member with photo-induced potential decaying properties is used (FIG. 1). In other words, a photosensitive member causing potential decaying characteristics proportional to the amount of exposure is demanded. From now on, this-type of photosensitive member is referred to as a J-type photosensitive member.

The above mentioned inorganic photosensitive members and functionally separated layered organic photosensitive members are the photosensitive members with potential decaying characteristics. All of the above are in this category.

However, in recent years, the necessity for improvements in high image quality, high additive values and networking have led to great steps in research. In digital mode electrophotographic copying apparatus, it is common that the area gradation system in which gradation is reproduced by dot area proportions is used. Accordingly, as shown in FIG. 2, there is another type of photosensitive member in which potential decay does not occur until the exposure amount has reached a predetermined level, i.e., a photosensitive member having the so-called S-type photo-induced potential decaying characteristics. When this fixed exposure amount is exceeded, sudden potential decay occurs (hereinafter referred to as an S-type photosensitive member). Use of the so-called S-type photopotential decaying photosensitive members results in increase in sharpness of the pixels and other welcome improvements.

The phenomenon of the S-type photo-induced potential decaying properties is well known in the single layered photosensitive members in which inorganic pigments such as ZnO or other pigments such as phthalocyanine are particle dispersed into a resin. See R. M. Schaffert: Electrophotography, Focal Press, pp 342 (1975), J. W. Weigl, J.Mammino, G. L.Whittaker, R. W. Radler, J. F. Byrne: Current problems in electrophotography, Walter de Gruyter, pp 287 (1972).

In particular, single layered photosensitive members for laser exposure which are sensitive to wavelengths of the near infra red region which corresponds to the oscillating wavelengths of semiconductors being widely used, have been suggested. See Gwen Chan Kay, Aizawa: Bulletin of Chemical Society of Japan, pp. 393 (1986), Japanese Patent Application Laid-Open(JP-A) Nos. 1-169454, 2-207258, 3-31847 and 5-313387.

However, in these single layered photosensitive members, it is necessary to have a single material which can function both as a charge generator and as a charge transporter. However, materials capable of performing both these functions are extremely rare, none of them is satisfactory in practice. In particular, the pigment particles generally possess many trap levels and this results in reduced charge transport ability. They also suffer from residual potential and are thus unsuitable charge transporters. The only exception is a single layered photosensitive member in which ZnO is dispersed in resin. In this instance, a printing plate is prepared by utilizing the hydrophilic properties of ZnO and the degree of adhesion of the hydrophobic toner to ZnO to obtain area gradation so that the sensitive member is used for a master plate for offset printing. See Kawamura: Electrophotographic techniques; rudiments and applications. Edited by Society of Electrophotography, Corona Publishing Co., pp. 424 (1988).

However, in this case, the sensitive member was used for a master plate which has low demands for high speed and high printing durability. In the field of use of the present invention, the photosensitive members used by copiers, printers, and other machines are not up to the required level of usability. From these points of view, in order to increase the freedom of choice of the materials for S-type photosensitive members and to increase the properties of the photosensitive members totally, the introduction of functionally separated layers is desired.

Regarding this problem, D. M. Pai et al. found that in a layered photosensitive member made up of the charge transport layer and the charge generation layer, the charge transport layer contains at least two charge transport regions and one electrically inactive region. The charge transport regions are in physical contact with each other so as to form a contorted charge transport path. Through the use of a heterogeneous charge transport layer comprising the contorted charge transport path and the combination of the charge generation layer with the transport layer, the S-type photo-induced potential decaying characteristics can be realized. See Japanese Patent Application Laid-Open (JP-A) No. 6-83077 and U. S. Pat. No. 5,306,586.

According to this report, the following methods of manufacturing heterogeneous charge transport layers formed by the contorted charge transport path in which charge transport regions are in contact with each other have been proposed: a manufacturing method of a heterogeneous charge transport layer in which organic or inorganic particles, or fine crystals capable of transporting charges are embedded in an insulating polymer; a manufacturing method in which a charge transport layer is made from a solid solution of charge transport molecules in a polymer binder, and, for example, one of the phases is crystallized; and a manufacturing method of a heterogeneous charge transport layer made by a block copolymer in which a charge transport block is encompassed by a charge non-transport block.

However, inorganic or organic particles, or crystallites capable of charge transporting normally possess many trap levels and thus when organic or inorganic particles or crystallites capable of charge transporting are embedded in an insulating polymer to make a heterogeneous charge transporting layer, the charge transporting ability is low or residual potential and other problems arise.

In addition, in a manufacturing method in which charge transport layers are made from solid solutions of charge transport molecules in polymer binders, and one of the phases is crystallized, compounds fulfilling the above conditions are rare. Accordingly, designing a photosensitive member capable of withstanding real usage is problematic.

Furthermore, a charge transport layer made from a block polymer enveloped in a charge non-transport block poses none of the above problems. However, it is difficult to maintain characteristics such as increased charge transport speed, reduction of residual potential and improved reproducing stability, and S-type properties at the same time.

By increasing the number of charge transport blocks to maintain the charge transport paths, the S-type properties deteriorate. By decreasing charge transport blocks to improve S-type properties, the charge transport paths get separated leading to reduced charge transport speed, increased residual potential, and less reproducing stability. Finding a photosensitive member which satisfies the above described characteristics at the same time was very difficult indeed.

SUMMARY OF THE INVENTION

The present invention was made in light of the above described problems in conventional technologies. An object of the present invention is to provide a new type of S-type photosensitive member capable of overcoming the above problems.

To put it another way, the object of the present invention is to provide an S-type photosensitive member with excellent electrophotographic properties, and high performance, for an electrophotographic photosensitive member comprising at least a charge generation layer and a charge transport layer on an electroconductive substrate.

In addition, another objective of the present invention is to provide an electrophotographic apparatus suited to digital and using high performance S-type photosensitive members.

The above described objects can be achieved by an electrophotographic photosensitive member (photoreceptor) comprised of a charge generation layer and a charge transport layer on an electroconductive substrate, wherein said charge transport layer comprises a polymer compound in a phase separated state with a modulated structure comprising an electrically inactive phase, and charge transport phase, an exposure amount required for 50% potential decay is less than five times the exposure amount required for 10% potential decay.

The modulated structure is a structure formed by phase separation into two phases from a homogeneous phase, through spinodal decomposition. In short, the modulated structure is a structure in which the two phases are mutually entwined in a complicated manner, and one phase is not isolated as it is in the sea island structure. FIG. 3 is a two dimensional schematic drawing of the modulated structure. In the present invention, the state, in which parts of both of the phases of the electrocharge transport phase and the electrically inactive phase form continuous phases exceeding five times of the phases at the cut surface of the phases, is defined as a modulated structure. The phase pitch is defined as representing the average phase thickness. (for example, represented by the width a in FIG. 3) In the sea island construction where the charge transport part is the island and the insulating part is the sea, the charge transport part is independent, so that hindrance of charge transport, increase in residual potential, reduction of photosensitivity and reduction in speed of charge transport and other factors become easier to cause and control becomes more difficult. In the sea island construction, where the insulating part is the island and the charge transport part is the island, the charge transport paths are maintained but the formation of spatial traps which cut off the charge for short periods becomes very problematic, and the S-type characteristics deteriorate.

The spatial traps are portions in which the charge transport part is projected in the direction of transporting charge. The spatial traps function only at the time when an electrical field is impressed. The existence of a number of these spatial traps is the key to the production of the S-type photo-induced potential decaying characteristics. When the modulating structure is comprised of the charge transport and insulating portions, the charge transport portion is not isolated, but is a continuous phase and thus, the charge transport path, without becoming separated, can carry out the transportation of electrical charge, and a number of portions which are capable of functioning as spatial traps and which are projecting in the direction to which electrical charge is transported are present, because the charge transport portions and the insulation portions are shuffled in a complicated manner.

As described above, where the modulated structure is composed of the charge transport portions and the insulating portions, the maintenance of the charge transport path and maintenance of the spatial traps are compatible, thus hindrance due to separation of the charge transport path, such as increases in residual potential, reduction in photosensitivity, reduction in speed of charge transport and the like do not arise. Thus an excellent S-type electrophotographic photosensitive member is achieved.

Using the present invention, polymers in the separated phase state with a modulated structure comprising an electrically inactive phase and the charge transport phase, so that S-type characteristics can be exercised without separation of the charge transport path.

The electrical inactivity mentioned here refers to the transport energy level being far apart from the transport charge level for main transporting charge, and at normal electrical field strengths, there is no substantial injection of transport charge and, in reality, for the main charge it refers to an electrically insulated state.

Further, the charge transport layer comprises a layer composed of a polymer compound in a phase separated state with a modulated structure composed of an electrically inactive phase and a charge transporting phase, and a layer composed of a charge transporting matrix, so that a smooth charge transport, high charge transport speed, and reduction of residual potential can be achieved.

Further, by the ordered layering of the charge transport layer comprising a layer comprising a polymer in a phase separated state with a modulated structure composed of an electrically inactive phase and a charge transporting phase, and a layer composed of a charge transporting matrix, the layer composed of the charge transporting matrix becomes the topmost layer and affords a photosensitive member with excellent abrasion resistance, ozone resistance, NOx resistance and the like. Through the use of the above electrophotographic photosensitive members, electrophotographic apparatuses comprising exposure means based on digitally processed image signals and possessing excellent image quality and image stability can be presented.

As a measure of the S-type of the photo-induced potential decay curve, a ratio of, for example, an exposure amount required for 50% potential decay (E50%) to an exposure amount required for 10% potential decay (E10%), i.e., E50%/E10% can be used.

With an ideal J-type photosensitive member, when an electrical potential decay is proportional to exposure amount, the value of E50%/E10% is 5.

With a normal J-type photosensitive member, the value of E50%/E10% exceeds 5, since efficiency of charge generation and/or charge transport is reduced in accordance with the reduction in electrical field strength. On the other hand, with the ultimate S-type, in which potential decay does not attenuate until a specific exposure amount is reached, and at this specific exposure amount, the potential suddenly decays to the potential residual level, having a stepwise photo-induced decay curve, the value of E50%/E10% is 1. Consequently, the S-type is defined as a type having a value of E50%/E10% within the range of 1–5.

From now on, the charge transport layer, comprising a polymer in the phase separated state with a modulated structure composed of an electrically inactive phase, and a charge transport phase is referred to as a heterogeneous charge transport layer. The charge transport layer formed from the charge transport matrix is referred to as a homogeneous charge transport layer.

In order for the above electrophotographic photosensitive members to be able to exercise S-type photo-induced potential decay characteristics, a mechanism to momentarily halt the participating charge of the heterogeneous charge transport layer, and a mechanism for transporting charge are necessary. Surface potential decays in proportion with the distance between the momentary charge halting mechanism and the charge generation layer when they are apart from each other. For this reason, it is preferable to have the momentary charge halting mechanism, i.e., the heterogeneous charge transport layer creates an excellent S-type model when the charge generation layer is close to the heterogeneous charge transport layer. Further, after momentarily halting the charge, the heterogeneous charge transport layer becomes unnecessary. In fact, rather than the heterogeneous charge transport layer which is unable to transport charge linearly, the homogeneous charge transport layer, which can transport charge smoothly, is considered advantageous in light of the charge transport speed.

DESCRIPTION OF THE PREFERRED EMBODIMENTS

The preferred embodiments of the present invention will be described hereinafter.

Figure 4:
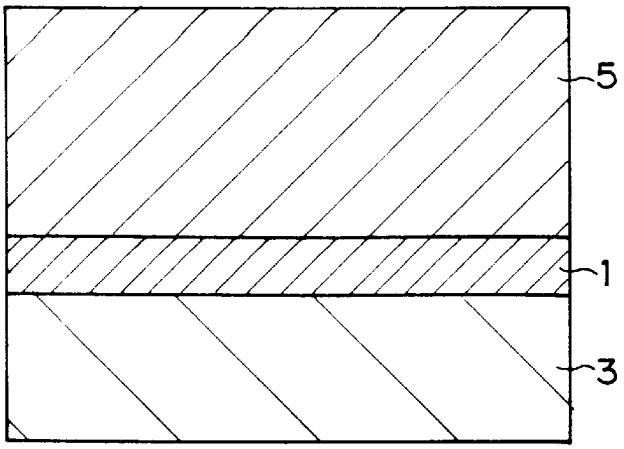
FIG. 4 is a schematic cross-sectional view of one example of preferred embodiments of the electrophotographic photosensitive member according to the present invention.
Figure 5:
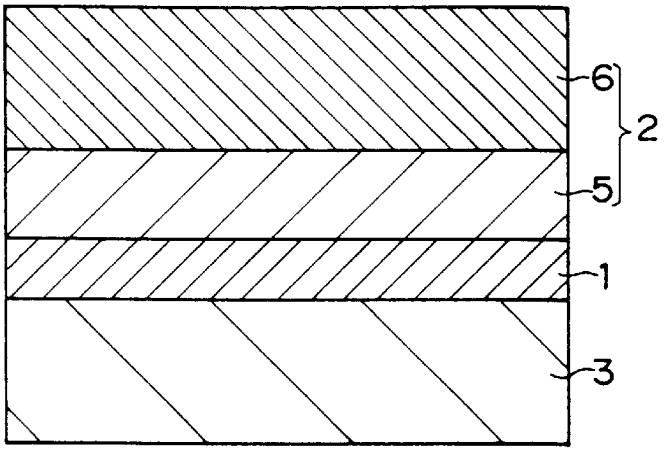
FIG. 5 is a schematic cross-sectional view of another example of preferred embodiments of the electrophotographic photosensitive member according to the present invention.

FIGS. 4 and 5 are schematic cross-sectional drawings of the electrophotographic photosensitive member s (photosensitive members) of the present invention. From FIG. 4, it can be seen that a charge generation layer 1 which is responsible for photoelectric charge generation is disposed on an electroconductive support 3. A heterogeneous charge transport layer 5 is provided on the charge generation layer 1.

In FIG. 5, the charge generation layer 1 responsible for photoelectric charge generation is disposed on an electroconductive support 3. The heterogeneous charge generation layer responsible for S-type modifications is disposed on the charge generation layer 1. Above this is disposed the homogeneous charge transport layer 6 responsible for smooth charge transport. The charge transport layer 2 is comprised of these layers.

Figure 6:
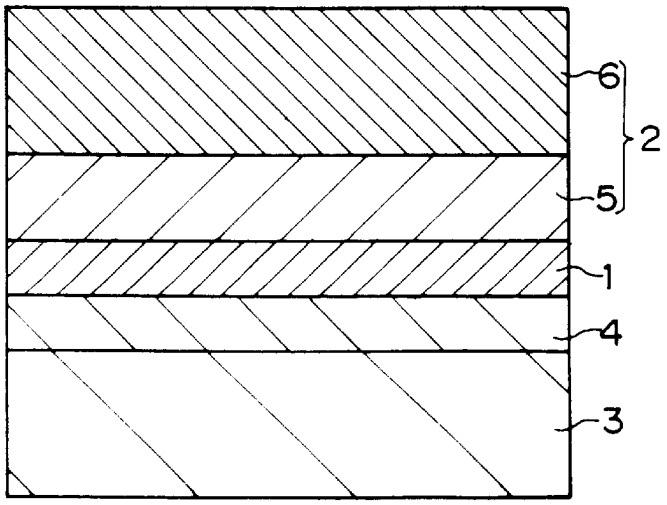
FIG. 6 is a schematic cross-sectional view of still another example of preferred embodiments of the electrophotographic photosensitive member according to the present invention.

In FIG. 6, an undercoating layer 4 is additionally disposed between an electroconductive support 3 and the charge generation layer 1.

Figure 7:
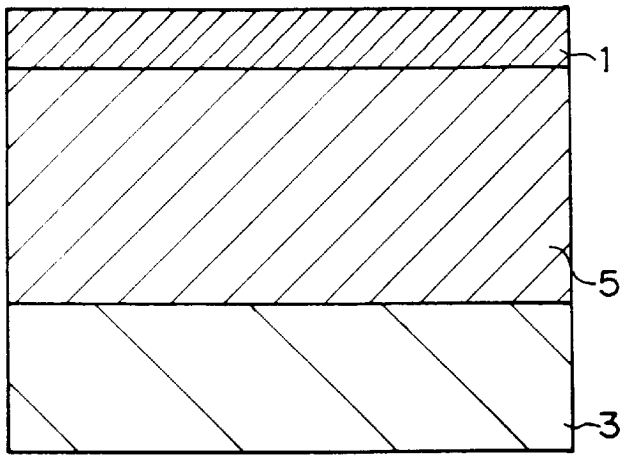
FIG. 7 is a schematic cross-sectional view of still another example of preferred embodiments of the electrophotographic photosensitive member according to the present invention.
Figure 8:
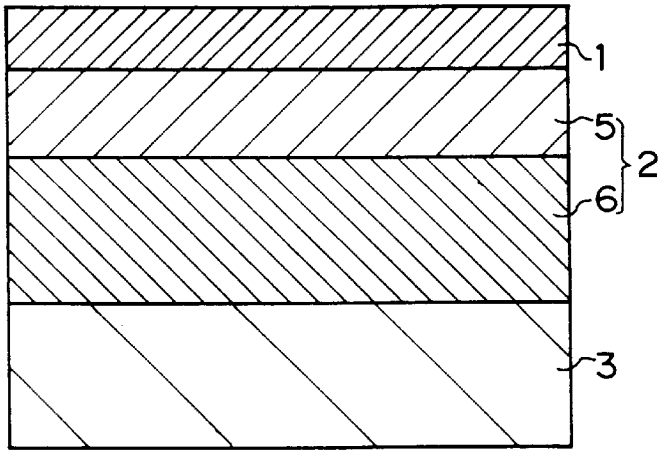
FIG. 8 is a schematic cross-sectional view of still another example of preferred embodiments of the electrophotographic photosensitive member according to the present invention.
Figure 9:
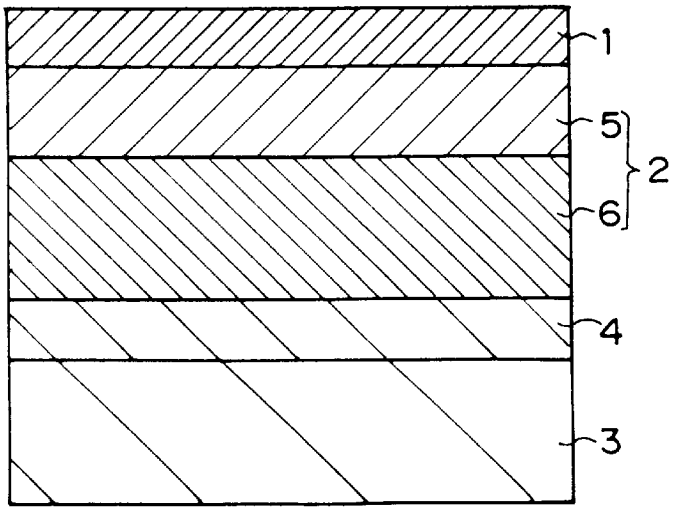
FIG. 9 is a schematic cross-sectional view of still another example of preferred embodiments of the electrophotographic photosensitive member according to the present invention.

FIGS. 7, 8 and 9 show schematic cross-sectional views of the other embodiments of the electrophotographic photosensitive member.

In FIG. 7, a heterogeneous charge transport layer 5 is disposed on an electroconductive support 3, and a charge generation layer 1 is disposed on a heterogeneous charge transport layer 5.

In FIG. 8, a charge generation layer 1 is disposed on a heterogeneous charge transport layer 5 which is, in turn, disposed on a homogeneous charge transport layer 6, on an electroconductive support 3.

In FIG. 9, an undercoating layer is disposed between an electroconductive support 3 and a homogeneous charge transport layer 6.

According to requirements, these electrophotographic photosensitive members may include a protective layer and/or an irregular reflection layer and the like on the charge generation layer 1.

As stated above, if the moving distance of the charge until the movement of the charge generated in the charge generation layer 5 is temporarily halted in the heterogeneous charge transport layer 5 is sufficiently small enough, relative to the total thickness of the photosensitive layer, the potential decay which takes place during this interval is negligible, so that an ideal S-type photosensitive member can be obtained. In other words, proximity of the charge generation layer 1 to the heterogeneous charge transport layer 5 for S-type characteristics leads to better S-type qualities. However, in order to assist charge injection or charge generation, it is possible to dispose an intermediate layer between the charge generation layer 1, and the heterogeneous charge transport layer 5. In addition, if necessary, in order to get imperfect S-type qualities close to the J-type, it is also possible to interpose a homogeneous charge transport layer between the charge generation layer 1, and the heterogeneous charge transport layer 5.

In addition to photoelectric functions, the surface layer also needs to be able to maintain charge at the time of charging. Resistance to products generated during charging such as ozone, NOx and other products, and resistance to abrasion caused by paper and cleaning members are also necessary.

As in FIG. 4, in a laminated layered type composed of only the charge generation layer 1 and the charge transport layer 5, having a heterogeneous structure, charge transport and S-type functions in addition to these functions are required in the heterogeneous charge transport layer 5. Carrying out all of these functions at the same time is very difficult. In the case of electrophotographic photosensitive members like those shown in FIGS. 5 and 6, because the homogeneous charge transport layer 5 is on the surface side, the S-type modifications are performed by the heterogeneous charge transport layer of the inside of the photosensitive layer. And thus the necessary functions of the surface layer outlined above can be designed through isolation of charge generation and S-type modifications. In this way freedom of design increases.

The electroconductive support 3 can be either opaque or substantially transparent. Aluminum, nickel, chromium, stainless steel, and other metals, and plastic film, glass or the like coated with a thin layer of aluminum, titanium, nickel, chromium, stainless steel, gold, vanadium, tin oxide, indium oxide, ITO, and the like, or paper, plastic film, or glass coated or impregnated with electroconduction imparting agents may be used.

These electroconductive supports 3 are used in appropriate forms, for example: drum form, sheet form, plate form, and such. However the forms used are not limited to just these. Further, if necessary, and as long as image quality is not affected adversely, various treatments can be carried out on the surface of the electroconductive support 3. For example, surface oxidation or chemical treatment, or coloration treatment and the like, or graining or irregular reflection treatment and the like can be employed.

Again, it is possible to dispose a single undercoat layer 4, or indeed several, between the electroconductive support 3 and the photoconductive layer.

At the time of charging of the photosensitive layer, the injection of charge from the electroconductive support 3 to the photosensitive layer is prevented by the undercoat layer 4. Simultaneously, the undercoat layer 4 acts as an adhesive layer for integrally allowing the photosensitive layer to be adhered to the electroconductive support 3. Also, according to the situation, it exhibits usage in prevention of optical reflection from the electroconductive support.

For the above undercoating layers, publicly known materials can be used. For example, polyethylene resin, acrylic resin, methacrylic resin, polyamide resin, vinyl chloride resin, vinyl acetate resin, phenol resin, polycarbonate resin, polyeurathane resin, polyimide resin, vinyldenechloride resin, polyvinylacetal resin, vinylchloride-vinyl acetate copolymer, polyvinyl alcohol resin, water soluble polyester resin, alcohol soluble nylon resin, cellulose nitrate, casein, gelatin, polyglutamic acid, starch, starch acetate, amino starch, polyacrylic acid, polyacrylic amides, and other resins or copolymers thereof can be used. Also, curable organic metal compounds such as zirconium alkoxide compounds, titanium alkoxide compounds, and silane coupling agents can be used. These compounds can be used singly or in combination.

It is also possible to utilize materials which are capable of transporting only charges of the same polarity as the electrocharging polarity. It is also preferable for the undercoat layers to be in the range of 0.01–10 $\mu$m thick, more preferably 0.05–5 $\mu$m thick.

For the coating method, blade coating, wire bar coating, spray coating, dip coating, bead coating, air knife coating, curtain coating and other common methods can be utilized.

As for charge generating materials for the charge generation layer 1 of the electrophotographic photosensitive member of the present invention, it is possible to use publicly known materials of the charge generation layer of the conventional J-type layered photosensitive members. For example, inorganic photoconductive materials such as amorphous selenium, selenium-tellurium alloys, selenium arsenic alloys, and other selenium compounds or alloys, zinc oxide, titanium oxide, a-Si, a-SiC and the like, organic pigments or dyes such as phthalocyanines, squaryliums, anthrones, perylenes, azos, anthraquinones, pyrenes, pyrylium salts, thiapyrylium salts, and the like may be used. The materials which can be used are not just limited to the above materials. Also, these pigments and dyes may be used individually or as mixtures of two or more.

Today the light sources favored in digital electrophotographic apparatus are the LED or laser diodes which have oscillating wavelengths of 600–850 nm. The phthalocyanine compounds have excellent photosensitivity in this range and are thus especially preferred as the charge generation material of the present invention. Specifically, non-metalophthalocyanine and metalo-phthalocyanine compounds are preferred. For the central metal in the metalophthalocyanine compounds, Cu, Ni, Zn, Co, Fe, V, Si, Al, Sn, Ge, Ti, In, Ga, Mg, Pb, and others can be cited. Also oxides, hydroxides, halides, alkylated compounds, alkoxylated compounds, and other central metals may be used. To put it directly, the following can be used: non metalophthalocyanine, titanyl phthalocyanine, chlorogallium phthalocyanine, hydroxy gallium phthalocyanine, vanadylphthalocyanine, chloroindium phthalocyanine, dichlorotinphthalocyanine and others. It is also possible to use compounds having appropriate substituents in the phthalocyanine ring. In addition, it is effective to substitute any of the carbon atoms of these phthalocyanine rings for nitrogen atoms. It is possible to use an amorphous form or a polymorphic form of these compounds.

Among these phthalocyanine compounds titanyl phthalocyanine, chlorogallium phthalocyanine, hydroxy gallium phthalocyanine and dichlorotinphthalocyanine have the most superior photosensitivity and are the most preferable for charge generation materials. Although most phthalocyanine compounds are p-semiconductors in which holes are n majority carriers, dichlorotinphthalocyanine is an n-semiconductor in which electrons are majority carriers. Accordingly, when an S-type photosensitive member comprising a charge generation layer containing dichlorotinphthalocyanine as a charge generation material, and a charge transport layer layered on an electroconductive substrate in this order, is used with a negative charge, excellent electrophotographic characteristics of high sensitivity and suppression of positive charge injections from the conductive substrate, small dark decay, and high charge can be obtained.

Hexagonal selenium has a high efficiency in charge generation, and therefore, it is preferably used as a charge generating material. Laser beam diameters get smaller when the oscillating wavelengths get shorter. Accordingly, shortening of oscillating wavelengths of lasers for exposure is studied for achieving high quality images. Hexagonal selenium has a photosensitive range of 680 nm or less, and is thus the most preferable charge generating material for short-wavelength-lasers within this range.

The charge generation layer can be constructed by vacuum deposition, or by dispersing or dissolving the above-described charge generating materials in binding resins. The following binding resins may be used to prepare the charge generation layer 1, but others are also possible: polyvinyl butyral resin, polyvinyl formal resin, partially modified polyvinyl acetal resin, polycarbonate resin, polyester resin, acrylic resin, polyvinyl chloride resin, polystyrene resin, polyvinyl acetate resin, vinylchloride/vinylacetate copolymer resin, silicone resin, phenol resin, poly-N-vinyl carbozole resin. These binding resins can be block copolymers, random copolymers, or alternating copolymers. They can be used individually or in mixtures of two or more.

The compounding ratio (volume ratio) of the charge generating material to the binding resin is preferably in the range of 10:1–1:10, more preferably, in the range of 3:1–1:1. If the compounding ratio of the charge generating material to the binding resin exceeds the above range, dark decay increases and mechanical properties deteriorate. If the compounding ratio is lower than the above range, photosensitivity decreases, residual potential increases and other problems occur.

The layer thickness of the charge generation layer of the present invention is normally in the range of 0.05 μm–5 μm. more preferably, within the range of 0.1–2.0 μm. As for the coating method of the charge generation layers, any of the following common methods can be employed: blade coating, wire bar coating, spray coating, dip coating, bead coating, air-knife coating, or curtain coating.

The heterogeneous charge transport layer 5 is a layer forming a charge transport path having a heterogeneous structure comprising a polymer compound in a phase separated state composed of the electrically inactive layer, which assumes the modulated structure, and the charge transport layer. The heterogeneous transport layer 5 can be obtained by coating a liquid in which an insulating polymer compound and charge transporting polymer compound are dissolved. This heterogeneous charge transport layer 5 can also be obtained by coating a liquid in which a copolymer including insulating portions and charge transporting portions are dissolved.

Known charge transporting polymers may be used. For example, a polymer having a group such as polyvinyl carbozole or others having charge transporting properties on their side chains, or a polymer compound with a group having a charge transporting property on the main chain thereof as disclosed in Japanese Patent Application Laid-Open (JP-A) No. 5-232727, and polysilane and the like can also be used. A charge transport polymer compound comprising at least one of the repeating units of the structure represented by Formula 1 or Formula 2 below is preferable because of high charge transport ability and excellent mechanical properties:

(1)

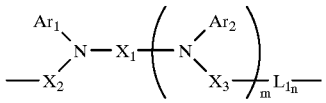

where $Ar_1$ and $Ar_2$ each represents independently a substituted or unsubstituted aryl group, $X_1$ represents a divalent hydrocarbon group having an aromatic ring structure or a hydrocarbon group containing a hetero atom, $X_2$ and $X_3$ each represents independently a substituted or unsubstituted arylene group, $L_1$ represents a divalent hydrocarbon group which may be branched or may contain a ring structure, or a hydrocarbon group containing a hetero atom, and m and n each represents an integer selected from 0 and 1;

(2)

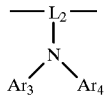

where $Ar_3$ and $Ar_4$ each represents independently a substituted or unsubstituted aryl group, and $L_2$ represents a trivalent hydrocarbon group having an aromatic ring structure or a hydrocarbon group containing a hetero atom.

Each of $Ar_1$ and $Ar_2$ in the above formula 1 represents independently a substituted or unsubstituted aryl group. Examples of the aryl group includes a phenyl group, biphenyl group, naphthyl group, pyrenyl group and the like. The substituents includes a methyl group, ethyl group, methoxy group, halogen atom and the like. $X_1$ represents a divalent hydrocarbon group having an aromatic ring structure or a hydrocarbon group containing a hetero atom. Examples of $X_1$ include a phenylene group, biphenylene group, terphenylene group, naphthylene group, methylenediphenyl group, cyclohexyledenediphenyl group, oxydiphenyl group, and substitution products thereof substituted with a methyl group, ethyl group, methoxy group or a halogen atom.

Each of $X_2$ and $X_3$ represents independently a substituted or unsubstituted arylene group. Examples $X_2$ and $X_3$ include a phenylenegroup, biphenylene group, terphenylene group, naphthylene group, methylenediphenyl group, cyclohexyledenediphenyl group, oxydiphenyl group, and substitution products thereof substituted with a methyl group, ethyl group, methoxy group or a halogen atom.

$L_1$ represents a divalent hydrocarbon group which may be branched or may contain a ring structure, or a hydrocarbon group containing a hetero atom. Although $L_1$ is arbitrarily selected from these groups as long as at least one of the above-described preferable characteristics is exhibited, groups having a bonding group selected from the group consisting of an ether bond, ester bond, carbonate bond, siloxane bond, and the like, and having carbon atoms of 20 or less are preferred. Preferred examples are shown below:

$—CH_2—O—CH_2—$ $—CH_2—CO—O—(CH_2)_2—$ $—(CH_2)_2—CO—O—(CH_2)_2—O—CO—(CH_2)_2—$ $—(CH_2)_2—CO—O—C_6H_4—O—CO—(CH_2O_2—$ $—(CH_2)_2—O—CO—C_6H_4—CO—O—(CH_2)_2—$ $—O—CO—O—C_6H_4—C(CH_3)_2—C_6H_4—O—CO—O—$ $—O—CO—O—(CH_2CH_2O)_2—CO—O—$ $—(CH_2)_2—Si(CH_3)_2—O—Si(CH_3)_2—(CH_2)_2—$

Each of $Ar_3$ and $Ar_4$ in the above formula 2 represents independently a substituted or unsubstituted aryl group. Examples of the aryl groups include a phenyl group, biphenyl group, naphthyl group, pyrenyl group, and the like. The substituents include an alkyl group having 1–12 carbon atoms, or an alkoxy group, diphenylamino group, a halogen atom and the like.

$L_2$ represents a trivalent hydrocarbon group having an aromatic ring structure or a hydrocarbon group containing a hetero atom. Although $L_2$ is arbitrarily selected from these groups as long as at least one of the above-described preferable characteristics is exhibited, groups having 20 or less carbon atoms are preferred. Examples of these groups are shown below:

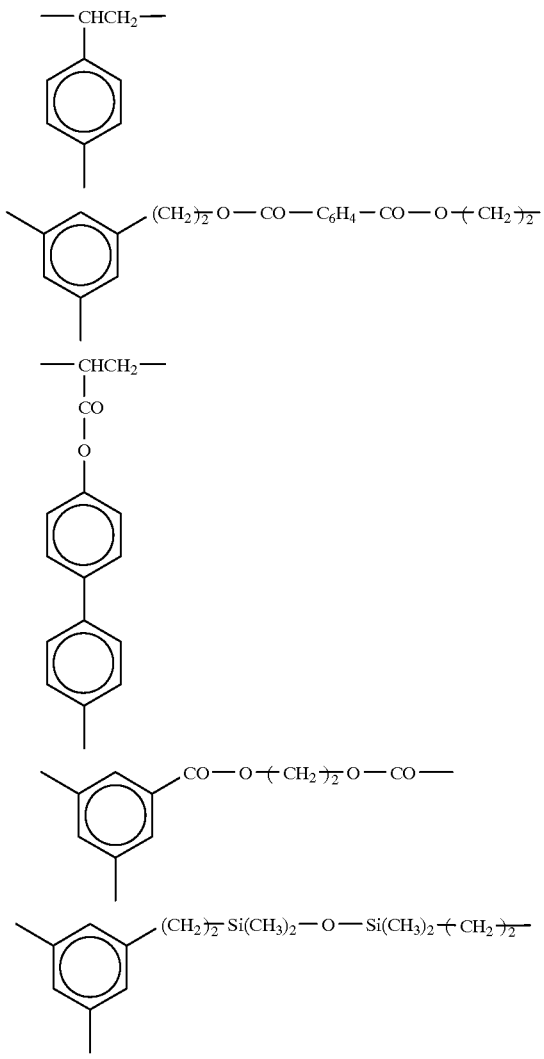

Concrete examples of the compounds represented by the above described formula 1 are shown in the following table 1 and 2, and concrete examples of the compounds represented by the above-described formula 2 are shown the following table 3, but the present invention is not limited to these compounds.

TABLE 1
| Structure | $X^1$ | $X^2$ | $X^3$ | $Ar^1$ | $Ar^2$ | L | m |
|---|---|---|---|---|---|---|---|
| 1 | 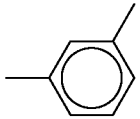 | 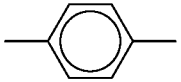 | 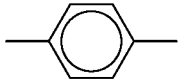 | 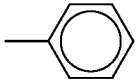 | 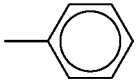 | L3 | 1 |
| 2 | 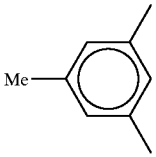 | 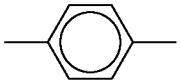 | 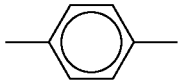 | 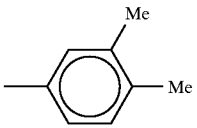 | 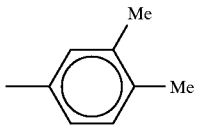 | L3 | 1 |
| 3 | 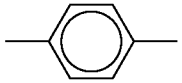 | 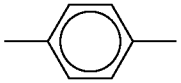 | | 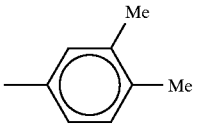 | | L2 | 0 |
| 4 | 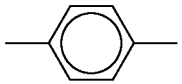 | 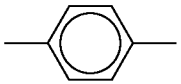 | | 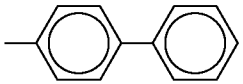 | | L1 | 0 |
| 5 | 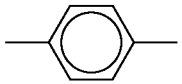 | 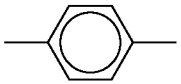 | | 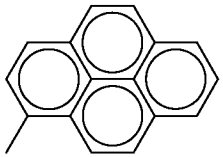 | | L1 | 0 |
| 6 | 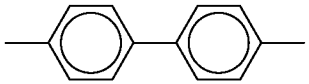 | 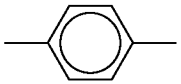 | 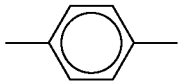 | 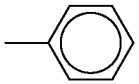 | 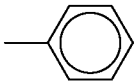 | L1 | 1 |
| 7 | 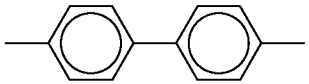 | 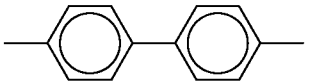 | 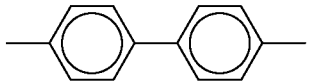 | 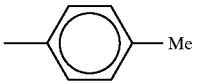 | 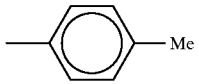 | L2 | 1 |

TABLE 1-continued
| Structure | $X^1$ | $X^2$ | $X^3$ | $Ar^1$ | $Ar^2$ | L | m |
|---|---|---|---|---|---|---|---|
| 8 | 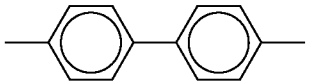 | 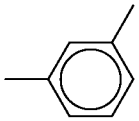 | 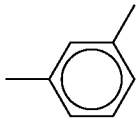 | 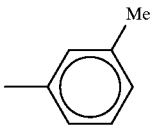 | 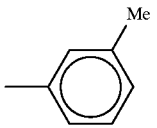 | L3 | 1 |
| 9 | 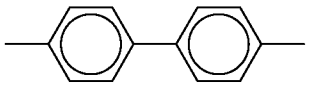 | 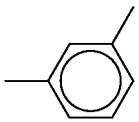 | 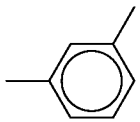 | 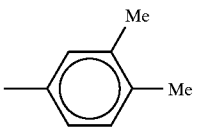 | 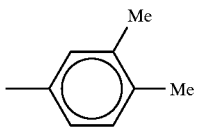 | L3 | 1 |
| 10 | 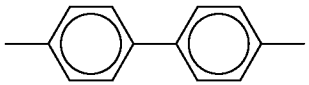 | 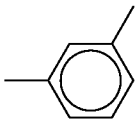 | 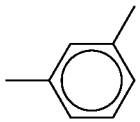 | 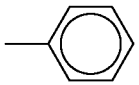 | 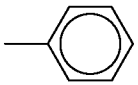 | L4 | 1 |
| 11 | 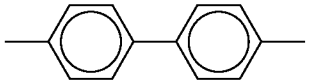 | 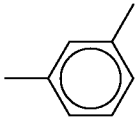 | 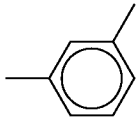 | 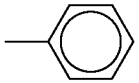 | 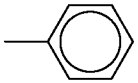 | L5 | 1 |
| 12 | 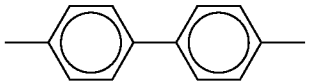 | 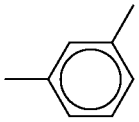 | 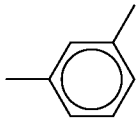 | 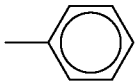 | 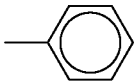 | L6 | 1 |
| 13 | 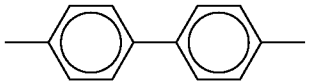 | 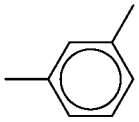 | 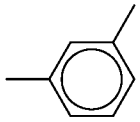 | 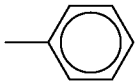 | 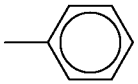 | L7 | 1 |
| 14 | 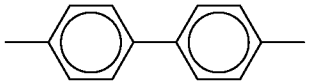 | 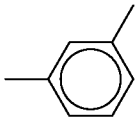 | 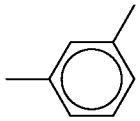 | 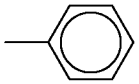 | 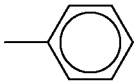 | L8 | 1 |

TABLE 2
| Structure | $X^1$ | $X^2$ | $X^3$ | $Ar^1$ | $Ar^2$ | L | m |
|---|---|---|---|---|---|---|---|
| 15 | 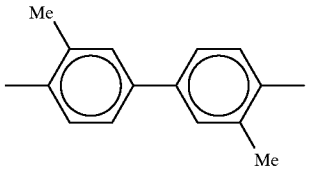 | 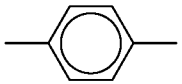 | 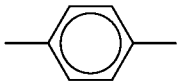 | 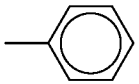 | 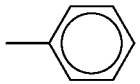 | L1 | 1 |
| 16 | 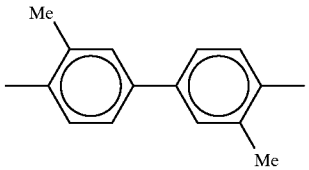 | 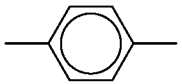 | 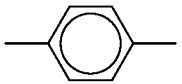 | 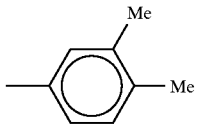 | 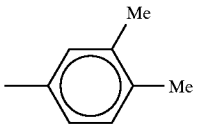 | L3 | 1 |
| 17 | 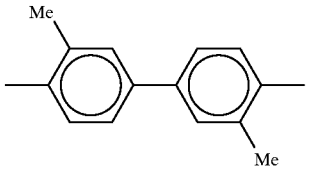 | 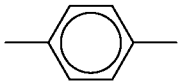 | 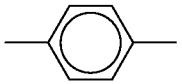 | 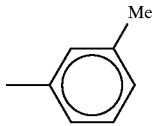 | 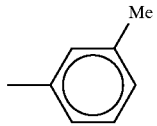 | L3 | 1 |
| 18 | 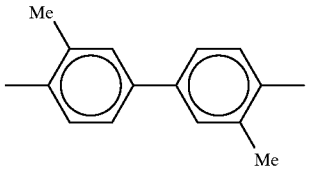 | 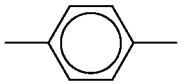 | 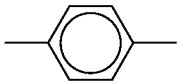 | 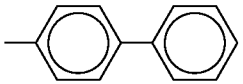 | 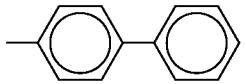 | L3 | 1 |
| 19 | 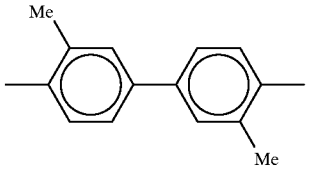 | 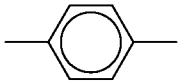 | 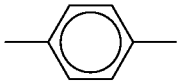 | 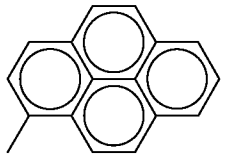 | 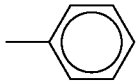 | L7 | 1 |

TABLE 2-continued
| Structure | $X^1$ | $X^2$ | $X^3$ | $Ar^1$ | $Ar^2$ | L | m |
|---|---|---|---|---|---|---|---|
| 20 | 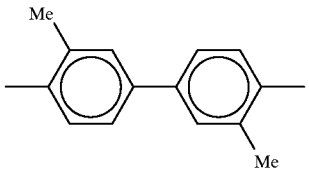 | 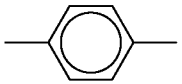 | 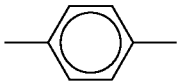 | 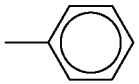 | 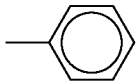 | L7 | 1 |
| 21 | 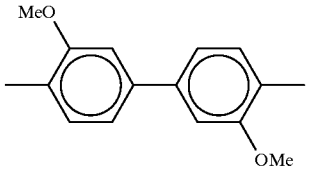 | 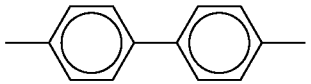 | 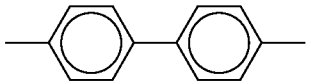 | 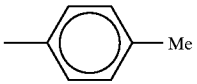 | 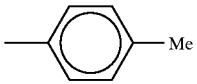 | L3 | 1 |
| 22 | 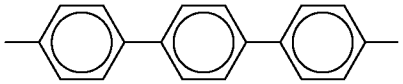 | 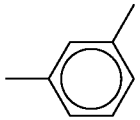 | 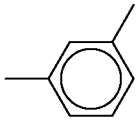 | 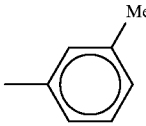 | 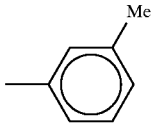 | L3 | 1 |
| 23 | 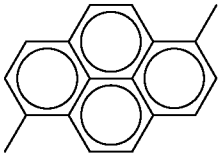 | 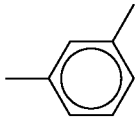 | 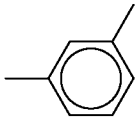 | 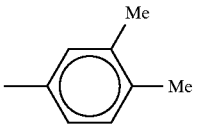 | 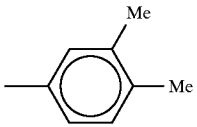 | L3 | 1 |
| 24 | 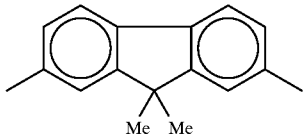 | 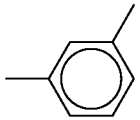 | 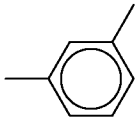 | 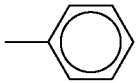 | 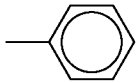 | L3 | 1 |

TABLE 2-continued
| Structure | $X^1$ | $X^2$ | $X^3$ | $Ar^1$ | $Ar^2$ | L | m |
|---|---|---|---|---|---|---|---|
| 25 | 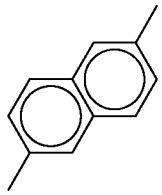 | 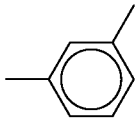 | 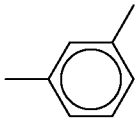 | 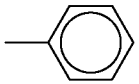 | 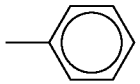 | L3 | 1 |
| 26 | 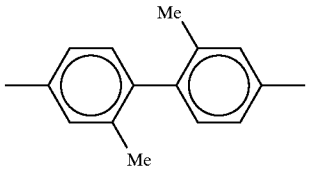 | 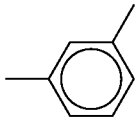 | 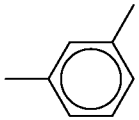 | 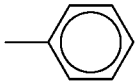 | 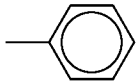 | L3 | 1 |
| 27 | 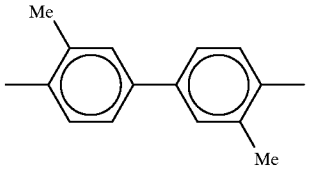 | 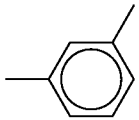 | 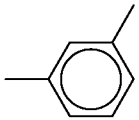 | 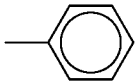 | 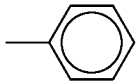 | L6 | 1 |
| 28 | 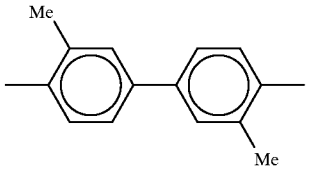 | 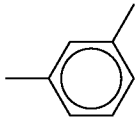 | 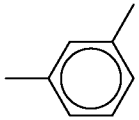 | 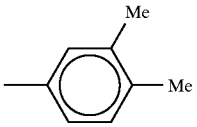 | 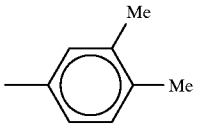 | L8 | 1 |

TABLE 3
| Structure | $Ar^3$ | $Ar^4$ | Y |
|---|---|---|---|
| 29 | 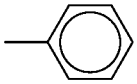 | 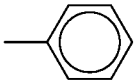 | Y1 |
| 30 | 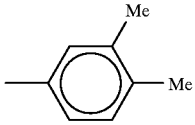  | 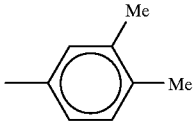  | Y1 |
| 31 | 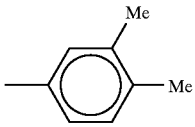  | 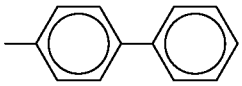 | Y3 |
| 32 | 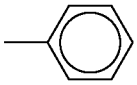 | 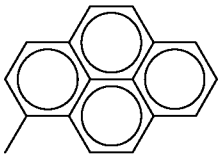 | Y3 |
| 33 | 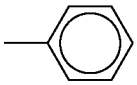 | 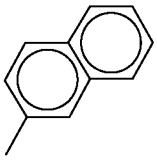 | Y3 |
| 34 | 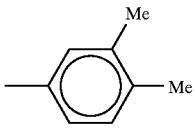  | 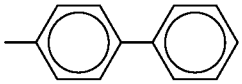 | Y1 |
| 35 | 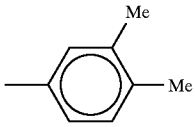  | 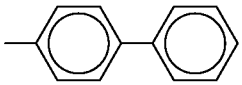 | Y2 |
| 36 | 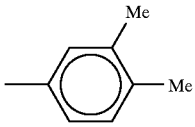  | 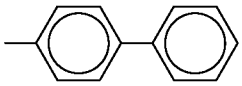 | Y3 |
| 37 | 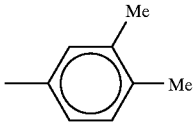  | 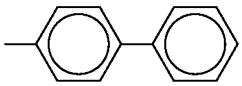 | Y4 |
| 38 | 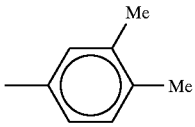  | 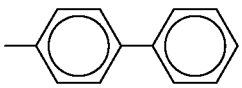 | Y5 |

TABLE 3-continued

| Structure | $Ar^3$ | $Ar^4$ | Y |
|---|---|---|---|
| 39 | 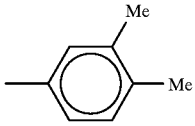 | 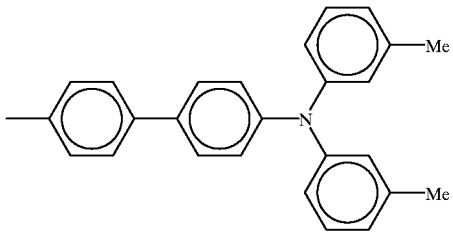 | Y6 |
| 40 | 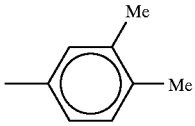 | 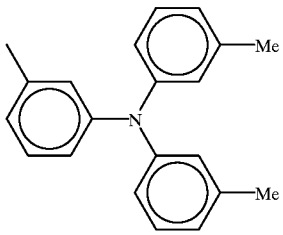 | Y7 |

Known insulating polymer compounds may be used. For example, the following resins and others not cited here can be utilized: polyvinylbutyral resin, polyvinylformal resin, partially modified polyvinylacetal resin, polycarbonate resin, polyester resin, acrylic resin, polyvinylchloride resin, polystyrene resin, polyvinylacetate resin, vinylchloride-polyvinylacetate copolymer, silicone resin, and phenol resin.

These binding resins can be a block copolymer, a random copolymer, or an alternating copolymer. They can be used singly or in mixtures of two or more. The binding resin comprising these insulating polymers preferably have volume resistivity of $10^{13}$ Ω·cm or more. Volume resistivity of $10^{14}$ Ω·cm or more is more preferable. If the volume resistivity of the binding resin is less than this value, the electric insulating property of the insulating polymer deteriorates and the S-type characteristics tend to be lost. Polycarbonate resins are especially preferable in the formation of a suitable phase separation structure with charge transporting polymer material. Bisphenol A type polycarbonate, bisphenol C type polycarbonate, bisphenol Z type polycarbonate and other known modified polycarbonate resins and their copolymers, and copolymers with other resins can be used as polycarbonate resins.

To make the modulated structure it is necessary to separate into two phases from a homogenous phase. In the case of a mixture which is separated from the homogenous phase into two phases upon heating, the modulated structure can be produced by cooling the layer of the homogenous phase after heat treatment. The modulated structure can also be made by dissolving components capable of forming the modulated structure in a common solvent to make the homogenous phase which is allowed to be separated into two phases through the process of solvent evaporation and concentration. Further, by dissolving components capable of forming the modulated structure in a mixed solvent to make a homogenous phase, and the homogenous phase is separated upon solvent evaporation into two phases in the process of changing composition of the solvent and thus the modulated structure can be made.

The volume ratio of charge transporting polymer to insulating polymer can be arbitrarily set within the range of 3/1–1/10, but the range of 7/3–2/8 is preferable. The range of 6/4–3/7 is more preferable. It becomes very difficult to assume the modulated structure if the volume ratio of the charge transporting polymer rises above or falls below the above values.

Figure 3:
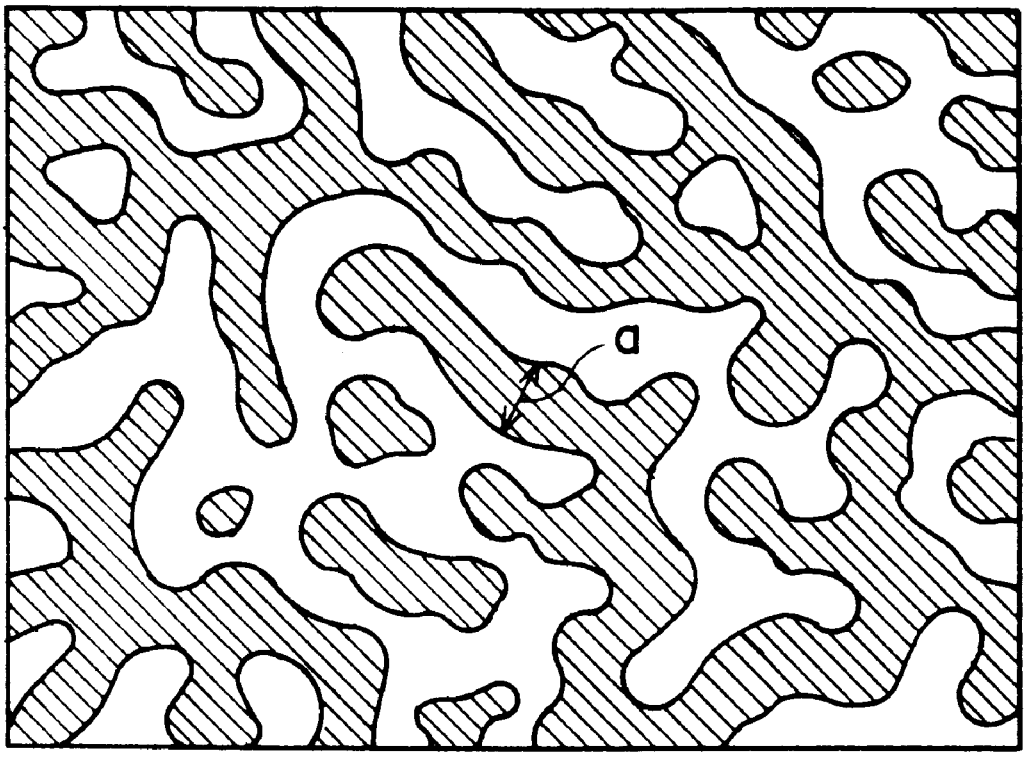
FIG. 3 is a two-dimensional schematic drawing of a modulated structure of the present invention.

The phase pitch of the charge transporting portion (see FIG. 3, for example, shown by width a) is affected by the heating and cooling conditions during the separation of the homogenous phase into two phases, but it is preferable for it to be in the range of 0.001–1 μm, more preferably from 0.005–0.5 μm, and especially preferable is the range 0.01–0.2 μm. If the phase pitch of the charge transporting portion is larger than the above values, within the range of preferable layer thickness, the probability of the formation of the spatial traps necessary for the S-type modification becomes low and the S-type property is lost. However, if the phase pitch of the charge transporting portion is less than the above values, the spatial trap becomes too shallow and the S-type property is lost.

Normally the phase pitch of polymer alloys is 1 μm or more, but the phase pitch has to be smaller to form the modulated structure of the present invention. In the case of polymer alloys, it is preferable that the solubility parameters (SP) of the charge transporting polymer and that of the insulating polymer are close to each other. The more the solubility parameters differ, the fewer become the solvents suitable to both, and the harder it gets to make the phase pitch smaller. It is preferable for the difference in solubility parameters between the charge transporting polymer and insulating polymer to be less than 2; less than 1 is more preferable and less than 0.5 is even more preferable. It is preferable for the solubility parameter of the solvent used in coating to be close to the values of the charge transporting polymers and the insulating polymers.

In order to make the phase pitch in the modulated structure smaller, it is preferable for the solubility parameter of the solvent being used to be between the solubility parameters of the charge transporting polymers and that of the insulating polymer. Moreover, in order to reduce the phase pitch in the modulated structure, a mutual solubility promoter can be added. Copolymers such as appropriate block copolymer resins or graft copolymer resins or other copolymers having an affinity for both the charge transporting polymers and the insulating polymers can be used as the mutual solubility promoter. Polymers which have an affinity for one of the charge transporting polymer and the insulating polymer and are reactive to the other can be used as the mutual solubility promoter. It is preferable for the resin parts which have the affinity, to be of the same structure as the charge transporting polymer portions and/or the insulating polymer portions.

Further, by addition of a polymer having a solubility parameter between the solubility parameter of the charge transporting polymer and that of the insulating polymer, it is possible to make the phase pitch of the modulated structure smaller. It is also possible to control the phase pitch through choice of solvent, use of mixed solvents, adjustment of rate of solvent evaporation, rate of cooling, and other methods.

A suitable layer thickness for the charge transport layer of the present invention is from 5–100 μm, preferably 10–50 μm. A suitable layer thickness for the heterogeneous charge transport layer is 0.1–50 μm, preferably 0.2–15 μm, more preferably 0.5–5 μm. When the layer thickness is smaller than the above range, the S-type property tends to be lost. The upper limit of the layer thickness is limited by the charge transportability of the S-type charge transport layer. It is set within the range of tolerance to response velocity, residual potential, and other factors.

By the addition of a compound which can transport only charge which is of the reverse polarity of the main transport charge in the heterogeneous charge transport layer, reduction of residual potential and improvements in repeating stability can be obtained. It is preferable for the compound to be included in the phase comprised of the insulating polymer.

In the coating of the heterogeneous charge transport layer, common methods such as blade coating, wire bar coating, spray coating, dip coating, bead coating, air-knife coating and curtain coating methods can be used.

For the homogenous charge transport layer, i.e., the layer comprising the charge transport matrix, it is possible to use a well known component used originally as the charge transport layer in the J-type layered photosensitive members. For example, a solid solution layer in which a hole transporting low molecular compound such as benzidine compounds, amine compounds, hydrazone compounds, stilbene compounds and carbozole compounds, and an electron transporting low molecular compound such as fluorenone compounds, malononitril compounds and diphenoquinone compounds, are homogeneously molecularly dispersed singly or in combinations of two or more thereof in an insulating resin such as polycarbonate, polyallylate, polyester, polysulfone, and poloymethylmethacrylate, all of which can be used. A polymer having charge transport ability as such can be used. Also, inorganic materials such as selenium, amorphous silicon, and amorphous silicon carbide, having charge transporting ability can be used. For the charge transporting polymer, polymers containing a group capable of charge transporting such as polyvinyl carbazole on side chains of the polymer, or a polymer having a group capable of charge transporting on the main chain of the polymer as disclosed in Japanese Patent Application Laid Open (JP-A) No. 5-232727, polysilane and the like can be used.

For the homogenous transport layer of the present invention, especially with respect to manufacture, use of charge transporting polymers is preferable. In other words, in the case that the heterogeneous charge transport layer and the homogenous charge transport layer are layered, the heterogeneous charge transport layer is contaminated with a charge transport low molecular compound when the charge transport low molecular compound in the homogenous charge transport layer is used, so that the insulation property to the main charge of the electrically inactive matrix of the heterogeneous charge transport layer are reduced, resulting in deterioration of S-type characteristics, or the contaminating molecules form charge traps, resulting in increases in residual potential, reductions in charge transport function, reductions in photosensitivity, and other problems.

These problems are particularly pronounced when all of the layers are made through the wet coating process. Of course, it is possible to avoid these problems by selecting a coating solvent, for an upper layer, which neither dissolves nor causes swelling of a lower layer, or by selecting a substance which has no mutual solubility with the charge transport low molecular compound as the electrically inactive matrix.

However, as is well known, in general, polymers cause phase separation without mutually dissolving with each other. When a charge transporting polymer is used as the homogeneous charge transport layer, the charge transporting polymer is not mutually dissolved with the electrically inactive matrix resin of the heterogeneous charge transport layer to be phase separated, and thus the aforementioned contamination problems are substantially unseen, and freedom from constraints on selection of materials and production methods can be realized. Because of the aforementioned reasons, it is preferable that the homogeneous charge transport layer comprising a charge transporting polymer does not contain more than 5% of a charge transporting compound having a molecular weight of less than 1000 in the homogenous charge transport layer.

Furthermore, it is preferable that a charge transport resin as a charge transporting polymer of the homogeneous charge transport layer contains at least one type of the structures represented by the aforementioned Formula 1 or Formula 2, as a repeating unit, since the charge transport resin exhibits high charge transportability and excellent physical properties.

An electrically inactive zone surrounded by the charge transport matrix may exist in the homogenous charge transport layer. For example, it is possible to incorporate insulating particles and the like in order to reduce surface friction, abrasion, adhesion of materials to the surface, and so on. In addition, it is possible for the homogenous charge transport layer to include charge transporting fine particles in order to enhance charge transportation.

The layer thickness of the homogenous charge transport layer of the present invention is in the range of 1–50 μm, preferably 5–30 μm. Blade coating, wire bar coating, spray coating, dip coating, bead coating, air knife coating, curtain coating and other common coating methods can be used for coating the homogenous charge transport layer. Also, compounds capable of vapor phase film formation can form a layer directly by vapor deposition. The total thickness of all the charge transport layers is normally from 5–100 μm, preferably within the range of 10–50 μm.

When the charge transport layer exists between the charge generation layer and the exposure light source, it is preferable for the charge transport layer to be practically transparent to the light of the exposure wavelength in order to prevent loss of effective photosensitivity. A transmittance of the charge transport layer is preferably 50% or more, and 70% or more is more preferable, and 90% or more is even more preferable, for the exposure light.

However, when use of low sensitivity is required, it is possible to adjust the effective photosensitivity by the use of a charge transport layer with actual light absorption of the exposure wavelengths.

It is possible to dispose a protective layer above the photoconductive layer composed of a charge generation layer and a charge transport layer, if necessary. This protective layer can protect the photoconductive layer from harmful products or chemical stresses such as ozone, oxidizing gases, ultraviolet light generated by the charging member, to increase the life span of the photoconductive layer. The protective layer also protects the photoconductive layer from mechanical stresses due to contact with a developing agent, paper, cleaning members and the like to increase the life span of the photoconductive layer. The effectiveness of this protective layer when used on a thin charge generation layer is marked.

The protective layer is formed by adding the conductive components to a suitable binding resin. The conductive materials can be prepared from metallocene compounds such as dimethyl ferrocene, metal oxides such as antimony oxide, tin oxide, titanium oxide, indium oxide and ITO, but are not limited to these compounds.

The following widely known resins may be used for the binding resin: polyamide, polyurethane, polyester, polycarbonate, polystyrene, polyacrylamide, silicon resin, melamine resin, phenol resin, epoxy resin and such. It is also possible to use amorphous carbon and a similar conductive inorganic layer as the protective layer. The protective layer should preferably have an electrical resistance within the range of $10^9$–$10^{14}$ Ω·cm. If the electrical resistance exceeds this range, the residual potential increases. On the other hand, if the resistance is lower than this range, charge leakage in the creepage surface direction becomes noticeable resulting in a reduction in resolving power. The thickness of the protective layer is suitably within the range of 0.5–20 μm, more preferably, within the range of 1–10 μm.

When disposing a protective layer, it is possible, if necessary, to include a blocking layer between the protective layer and the photosensitive layer in order to prevent the leakage of charge to the photosensitive layer from the protective layer. Known materials can be used for the blocking layer, similar to those of the protective layer.

In order to protect the electrophotographic photosensitive member of the present invention from the harmful effects of ozone, oxidizing gases generated in the electrophotographic apparatus, or light, and heat. It is possible to add antioxidants, stabilizers to light, stabilizers to heat and the like to all the layers, or just the topmost layer.

Known compounds such as hindered phenol, hindered amine, paraphenylenediamine, hydroquinone, spiro chroman, spiro indanon, and their derivatives, organic sulfur compounds, or inorganic phosphorous compounds can be used as the antioxidants.

Known compounds such as benzophenone, benzotriazole, dithiocarbamate, tetramethylpiperidine and their derivatives, and compounds which can cause deactivation of the photo-excited state by energy transfer or charge transfer through electron attracting compounds or electron donating compounds can be used as the stabilizers to light. Furthermore, in order to reduce surface abrasion, improve transferring, cleaning and other properties, it is possible to disperse insulating particles such as fluorine resins into the surface layer.

An electrophotographic apparatus provided with an electrophotographic photosensitive member of the present invention can be any type of apparatuses utilizing the electrophotographic method. However, electrophotographic apparatuses in which exposure based on the digitally processed image signals is performed is preferred. In the electrophotographic apparatus, light sources such as a laser and an LED are used, and exposure id performed by a light with binarization, pulse-width modulation or intensity modulation. For example, LED printers, laser printers, laser exposure type digital copying machines and others. An s-type photosensitive member has a value of E50%/E10% of less than 5. To gain preferable digital properties, a value of less than 3 for E50%/E10% is preferable. A value of less than 2 is more preferable. In order to initialize the photosensitive member after development, or stabilize electrophotographic properties, it is possible to use an exposure light source separate from the image forming exposure light source. The light emitted from the light source may have the wavelengths absorbed by the heterogeneous charge transport layer, but it is preferable that at least some light reaches the charge generation layer.

EXAMPLES

The present invention is described below in detail with examples. However, the present invention is not specifically limited by the following examples and it is possible for persons with knowledge of electrophotographic techniques to make alterations.

Example 1

A solution composed of 20 parts by weight of zirconium alkoxide compounds (Trade name: Orgatics ZC 540, manufactured by Matsumoto Chemical Industries Co., Ltd.), 2 parts by weight of y aminopropyl triethoxysilane (Trade name: A 1100, manufactured by Nippon Unicar Co., Ltd.), 1.5 parts by weight of polyvinylbutyral resin (S-Lec BM-S Sekisui Chemical Co., Ltd.), and 70 parts by weight of butanol was dip coated onto an aluminum plate, and dried by heating at 170° C. for ten minutes to produce an undercoating layer of 1.0 μm in layer thickness.

Next, 4 parts by weight of chlorogallium phthalocyanine crystals, 2 parts by weight of vinylchloride-vinylacetate copolymer (Trade name: UCAR Solution Vinyl Resin VMCH, Union Carbide Company), 67 parts by weight of xylene, and 33 parts by weight of butyl acetate, were mixed and then processed along with 1 mm ϕ glass beads in a sand grinder for two hours. After thus being particle dispersed, the coating solution produced was coated on the above mentioned undercoating layer by dip coating method. The applied coating was then dried by heat treatment at 100° C. for ten minutes to form a charge generation layer of 0.2 μm in layer thickness.

Next, 8 parts by weight of polymer charge transporting material having a molecular weight of 80,000 comprising a repeating unit represented by the following Formula 3 and an insulating polymer with a volume resistivity of $10^{14}$ Ω·cm, 12 parts by weight of a random copolymer of bisphenol A type polycarbonate having a molecular weight of 40,000, and bisphenol Z type polycarbonate (A type 75 parts by weight, Z type 25 parts by weight) were dissolved in 80 parts by weight of monochlorobenzene to form a coating solution which was coated on the above-mentioned charge generation layer by the dip coating method and dried by heat treatment at 130° C. for one hour to form a heterogeneous charge transport layer with a layer thickness of 20 μm. The electrophotographic photosensitive member having a layer structure shown in FIG. 4 was produced.

(3)

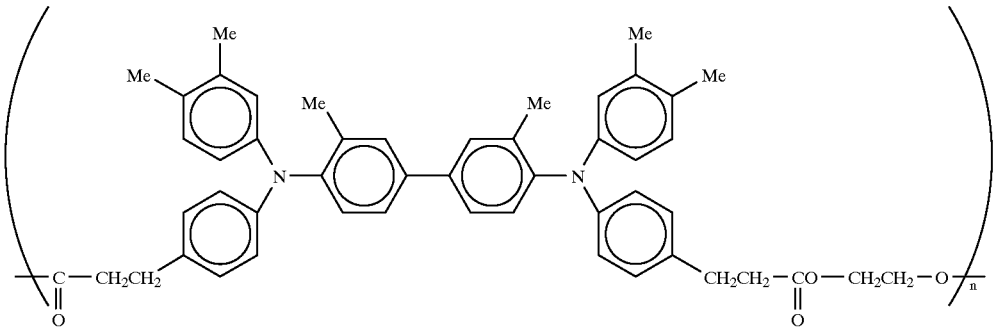

Figure 10:
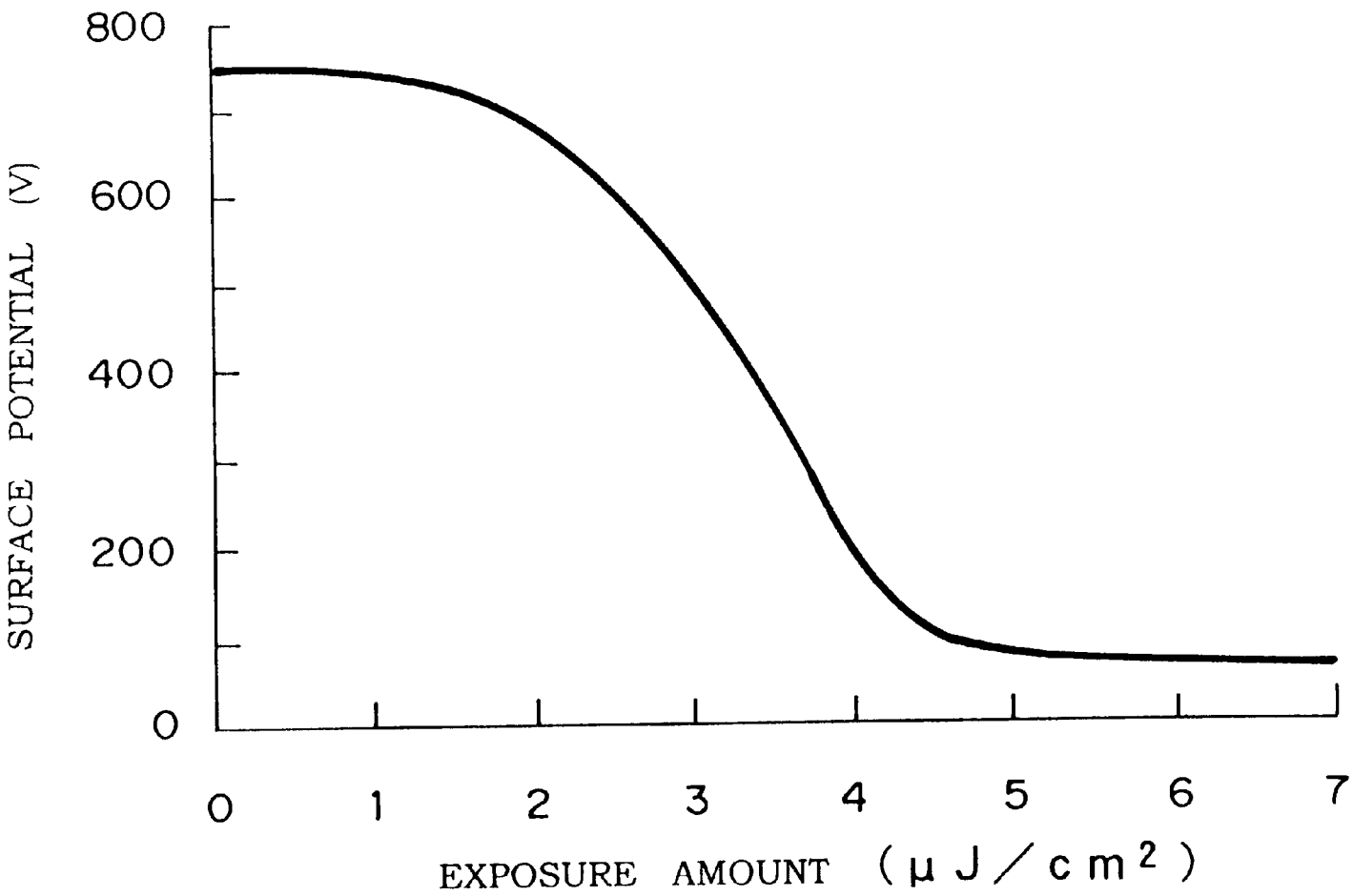
FIG. 10 is a graph showing photo-induced potential decay characteristic of the electophotographic photosensitive member of Example 1.

With respect to the electrophotographic photosensitive member produced in this manner, an electrostatic copying paper testing apparatus (Electrostatic analyzer EPA 8100, manufactured by Kawaguchi Denki K. K.) was used at normal temperature and humidity (20° C., 40%RH) to evaluate the electrophotographic characteristics. After charging the surface of the photosensitive member with 750V by controlling the voltage of a Corona discharger, the photosensitive member was irradiated by the light having a monochromatic wavelength of 750 nm from a halogen lamp passed through an interference filter for 7 seconds by controlling the luminosity of 2 mW/cm$^2$ at the surface of the photosensitive member. The photosensitive member showed an S-type photo-induced potential decay as shown in FIG. 10. From this photo-induced potential decay curve the E50% value is 3.1 mJ/m$^2$, the E50%/E10% value is 1.7, and the residual potential was determined to be 45V.

When the cross-section of the photosensitive member was stained with ruthenium acid and observed under a transmission electron microscope, an intricately tangled structure, thought to be the modulated structure, was seen to be comprised of light and dark sections. This showed that the phase of the compound composed of a repeating unit represented by Formula 3 of a polymer charge transporting material and the phase of polycarbonate of an insulating polymer were in a phase separated state. One phase was assumed to be stained by the ruthenium acid. The phase pitch was approximately 0.2 m.

Comparative Examples

Electrophotographic photosensitive members were prepared in the same way as in Example 1 except that ratios of the polycarbonate in the charge transport layer were those in Table 1. The electrophotographic photosensitive members thus produced were evaluated for electrophotographic properties and observed under the electron microscope in the same way as in Example 1. The results are shown in Table 4.

TABLE 4

| | Ratio of Polycarbonate in Charge Transport | Results of Evaluation of Electric Performance | | | Observation with Electron |
|---|---|---|---|---|---|
| | Layer (parts by weight) | E50% (mJ/m$^3$) | E50%/E10% | Residual Potential | Microscope |
| Example 1 | 60 | 3.1 | 1.7 | 45 | Intricately Tangled Structure |

TABLE 4-continued

| | Ratio of Polycarbonate in Charge Transport | Results of Evaluation of Electric Performance | | | Observation with Electron |
|---|---|---|---|---|---|
| | Layer (parts by weight) | E50% (mJ/m$^3$) | E50%/E10% | Residual Potential | Microscope |
| Comparative Example 1 | 50 | 3.0 | 1.9 | 40 | Sea Island Structure |
| Comparative Example 2 | 70 | 7.6 | 2.4 | 82 | Sea Island Structure (Dark and light portions are reversed) |
| Comparative Example 3 | 0 | 2.4 | 5.1 | 7 | — |

Example 2

An electrophotographic photosensitive member was prepared in the same way as in Example 1 except that hydroxygalliumphthalocyanine crystallites were used instead of chlorogalliumphthalocyanine crystallites. As for the solvent used during dispersion of the crystallites, monochlorobenzene was used instead of xylene and butyl acetate. The electrophotographic photosensitive member obtained in this way was evaluated in the same way as in Example 1. The photo-induced potential decay property of the photosensitive member showed an s-type properties having an E50% value of 2.7 $\mu$J/cm$^2$ and an E50%/E10% value of 1.8.

Example 3

An electrophotographic photosensitive member was prepared in the same way as in Example 1 except that titanylphtahalocyanine crystallites were used in place of chlorogalliumphthalocyanine crystallites. The electrophotographic photosensitive member thus prepared was evaluated in the same manner as in Example 1. The photo-induced potential decay property of the photosensitive member showed an s-type property having an E50% value of 3.4 $\mu$J/cm$^2$, and an E50%/E10% value of 1.9.

Example 4

An electrophotographic photosensitive member was prepared in the same way as in Example 1 except that the thickness of the charge transport layer was 10 $\mu$m. On this charge transport layer, a coating solution in which 20 parts by weight of compound having molecular weight of 80,000 as a polymer charge transport material, composed of repeating units represented by Formula 2 was dissolve in 80 parts by weight of monochlorobenzene was coated by an applicator and dried at 135° C. over one hour to form a homogeneous charge transport layer having a layer thickness of 15 μm. Thus, An electrophotographic photosensitive member having a layer structure as shown in FIG. 5 was obtained. The electrophotographic photosensitive member thus prepared was evaluated in the same manner as in Example 1. The photo-induced potential decay property of the photosensitive member showed an s-type property having an E50% value of 3.9 $\mu J/cm^2$ and an E50%/E10% value of 2.1.

Example 5

Figure 11:
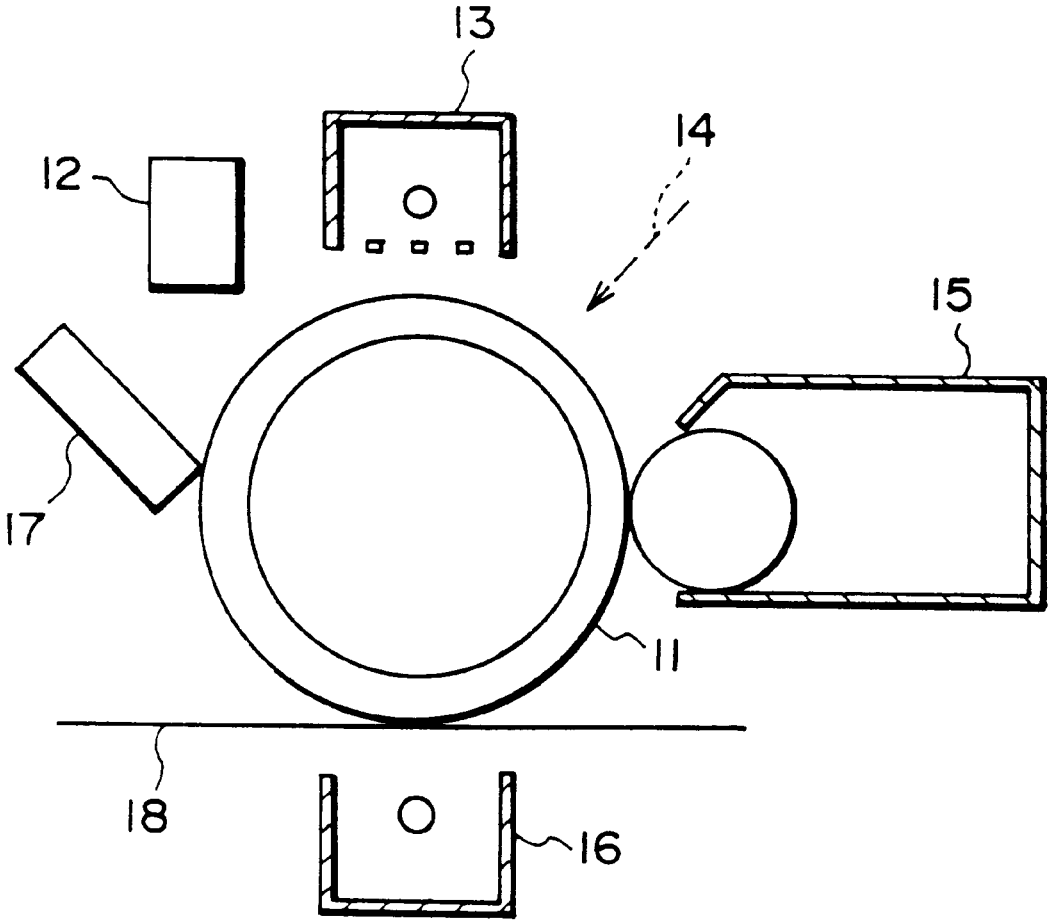
FIG. 11 is a schematic structural drawing of an electrophotographic apparatus, in which an exposure is effected based on digitally processed image signals, which was used in Examples of the present invention.

An electrophotographic photosensitive member was prepared in the same way as in Example 1 except that an aluminum drum was used instead of an aluminum plate and installed on a laser printer (Laser Press 4105, manufactured by Fuji Xerox Co., Ltd.), and the printing test was carried out. At the time of the test, an ND filter was inserted into the optical path of the laser light to obtain an optimum exposure light amount. FIG. 11 shows a schematic structural drawing of the laser printer thus prepared.

A light source 12 (red LED) for pre-exposure, a charging scorotron 13, a laser optical system 14 for exposure, a developer 15, a corotron 16 for transfer and a cleaning blade 17 were disposed on the periphery of the photosensitive drum 11 in the processing sequential order.

The exposure laser optical system 14 is provided with a laser diode for exposure which emits light of oscillating wavelength of 780 nm based on digitally processed image signals. The photosensitive member is exposed by scanning the laser beam 14*a* through a polygon mirror and a plurality of lenses and mirrors.

Comparative Example 4

An electrophotographic photosensitive member was prepared in the same way as in Comparative Example 3 except that an aluminum drum was used instead of an aluminum plate, and a print test was performed in the same manner as in Example 5. Print quality obtained by Example 5 was compared with that obtained by Comparative Example 3, the print quality obtained by Example 5 was superior to that of Comparative Example 3 in reproduction of fine lines.

The electrophotographic photosensitive member of the present invention, is a photosensitive member having an s-type photo-induced potential decaying characteristic. The electrophotographic photosensitive member which has a charge transport layer composed of a modulated structure comprising charge transporting portions and insulating portions, provides an excellent s-type property without problems such as increase in residual potential, reduction in photosensitivity and reduction in charge transporting speed due to separation of charge transporting paths.

An electrophotographic apparatus, in which an s-type electrophotographic photosensitive member is used and exposed based on digitally processed image signals, can provide a high print quality and a high printed image quality.

What is claimed is:

1. An electrophotographic photosensitive member comprising a charge generation layer and a charge transport layer on an electroconductive substrate, wherein the charge transport layer comprises a first layer comprising a polymer in a phase separated state with a modulated structure comprising an electrically inactive phase and a charge transporting phase, and a second layer comprising a charge transporting matrix, wherein an exposure light amount required for 50% potential decay is less than five times of an exposure light amount required for 10% potential decay.

2. An electrophotographic photosensitive member according to claim 1, wherein the charge generating layer and the charge transport layer are adjacent to each other.

3. An electrophotographic photosensitive member according to claim 2, wherein the charge generating layer, the first layer in the charge transport layers and the second layer in the charge transport layer are layered in that order on the electroconductive substrate.

4. An electrophotographic photosensitive member according to claim 3, wherein the second layer is composed of a charge transporting polymer.

5. An electrophotographic photosensitive member according to claim 4, wherein the charge transporting polymer contains as a repeating unit at least one compound represented by Formula 1;

(1)

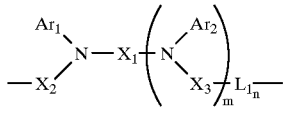

wherein $Ar_1$ and $Ar_2$ each represents independently a substituted or unsubstituted aryl group, $X_1$ represents a divalent hydrocarbon group having an aromatic ring structure, $X_2$ and $X_3$ each represents independently a substituted or unsubstituted arylene group, $L_1$ represents a divalent hydrocarbon group which may be branched or may contain a ring structure, and m and n each represents an integer selected from 0 and 1.

6. An electrophotographic photosensitive member according to claim 3, wherein the charge generation layer contains a phthalocyanine compound as a charge generating material.

7. An electrophotographic photosensitive member according to claim 2, wherein the second layer is composed of a charge transporting polymer.

Figure 1:
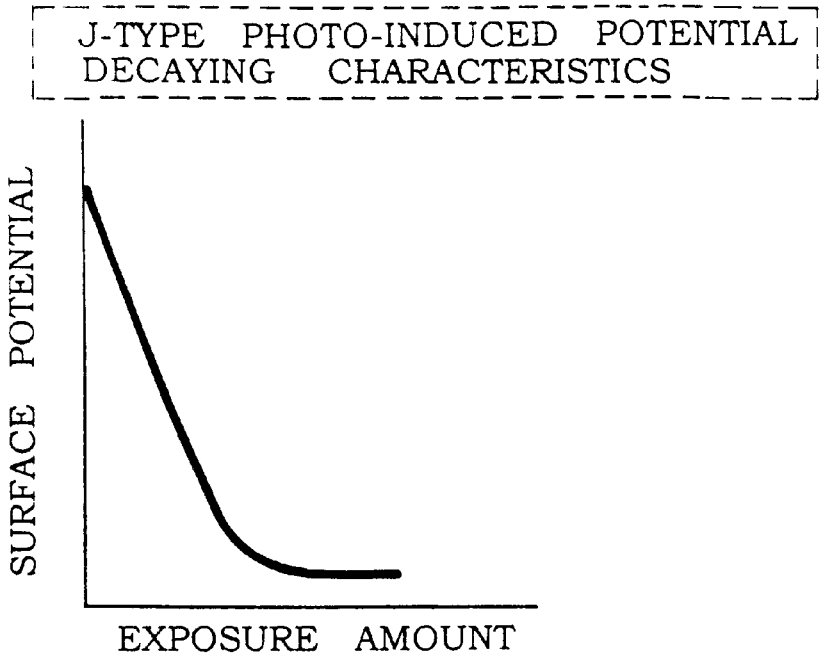
FIG. 1 is a graph showing the relationship between the exposure amount and the surface potential in a J-type electrophotographic photosensitive member.
Figure 2:
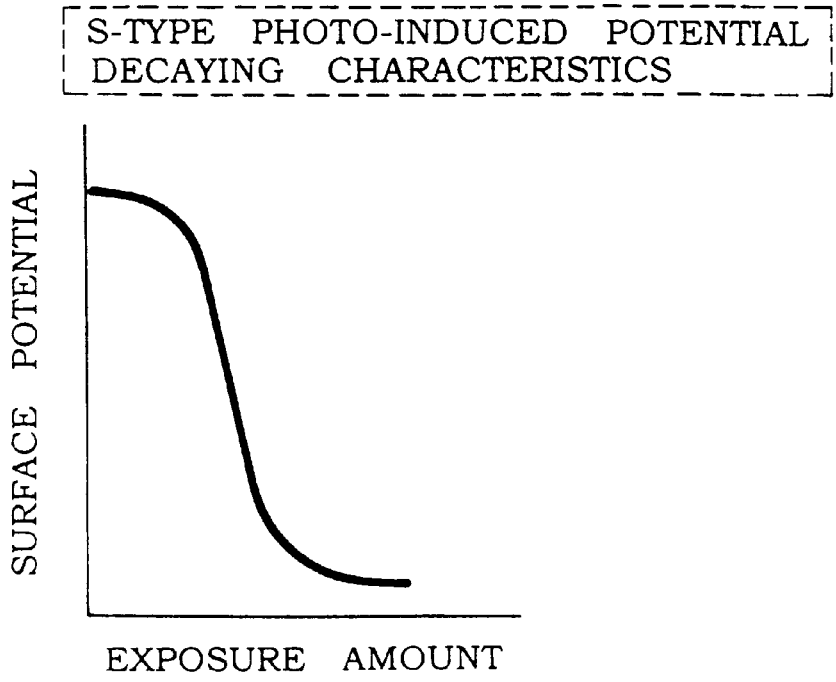
FIG. 2 is a graph showing the relationship between the exposure amount and the surface potential in an S-type electrophotographic photosensitive member.

8. An electrophotographic photosensitive member according to claim 7; wherein the charge transporting polymer contains at least one compound represented by FIG. 1 as a repeating unit;

(1)

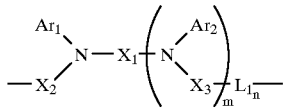

wherein $Ar_1$ and $Ar_2$ each represents independently a substituted or unsubstituted aryl group, $X_1$ represents a divalent hydrocarbon group having an aromatic ring structure, $X_2$ and $X_3$ each represents independently a substituted or unsubstituted arylene group, $L_1$ represents a divalent hydrocarbon group which may be branched or may contain a ring structure, and m and n each represents an integer selected from 0 and 1.

9. An electrophotographic photosensitive member according to claim 2, wherein the charge generation layer contains a phthalocyanine compound as a charge generating material.

10. An electrophotographic photosensitive member according to claim 1, wherein the polymer comprises a mixture of an electric insulating polymer and a charge transporting polymer.

11. An electrophotographic photosensitive member according to claim 10, wherein the insulating polymer has an electrical resistivity of no less than $10^{13}$ Ω cm.

12. An electrophotographic photosensitive member according to claim 11, wherein the charge transporting polymer contains at least one structure represented by Formula 1 or Formula 2 as a repeating unit;

(1)

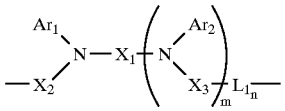

wherein $Ar_1$ and $Ar_2$ each represents independently a substituted or unsubstituted aryl group, $X_1$ represents a divalent hydrocarbon group having an aromatic ring structure, $X_2$ and $X_3$ each represents independently a substituted or unsubstituted arylene group, $L_1$ represents a divalent hydrocarbon group which may be branched or may contain a ring structure, and m and n each represents an integer selected from 0 and 1;

(2)

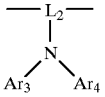

wherein $Ar_3$ and $Ar_4$ each represents independently a substituted or unsubstituted aryl group, and $L_2$ represents a trivalent hydrocarbon group having an aromatic ring structure.

13. An electrophotographic photosensitive member according to claim 12, wherein the insulating polymer contains a polycarbonate resin.

14. An electrophotographic photosensitive member according to claim 12, wherein the charge generation layer contains a phthalocyanine compound as a charge generating material.

15. An electrophotographic photosensitive member according to claim 12, wherein an exposure amount required for 50% potential decay is less than 3 times the exposure amount required for 10% potential decay.

16. An electrophotographic photosensitive member according to claim 11, wherein the charge generation layer contains a phthalocyanine compound as a charge generating material.

17. An electrophotographic photosensitive member according to claim 10, wherein the charge transporting polymer contains at least one structure represented by Formula 1 or Formula 2 as a repeating unit;

(1)

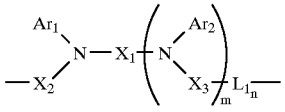

wherein $Ar_1$ and $Ar_2$ each represents independently a substituted or unsubstituted aryl group, $X_1$ represents a divalent hydrocarbon group having an aromatic ring structure, $X_2$ and $X_3$ each represents independently a substituted or unsubstituted arylene group, $L_1$ represents a divalent hydrocarbon group which may be branched or may contain a ring structure, and m and n each represents an integer selected from 0 and 1;

(2)

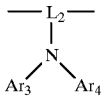

wherein $Ar_3$ and $Ar_4$ each represents independently a substituted or unsubstituted aryl group, and $L_2$ represents a trivalent hydrocarbon group having an aromatic ring structure.

18. An electrophotographic photosensitive member according to claim 12, wherein the insulating polymer contains a polycarbonate resin.

19. An electrophotographic photosensitive member according to claim 17, wherein an exposure amount required for 50% potential decay is less than 3 times the exposure amount required for 10% potential decay.

20. An electrophotographic photosensitive member according to claim 10, wherein the charge generation layer contains a phthalocyanine compound as a charge generating material.

21. An electrophotographic photosensitive member according to claim 10, wherein the charge transporting polymer contains at least one structure represented by Formula 1 or Formula 2 as a repeating unit;

(1)

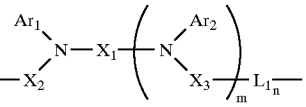

wherein $Ar_1$ and $Ar_2$ each represents independently a substituted or unsubstituted aryl group, $X_1$ represents a divalent hydrocarbon group having an aromatic ring structure, $X_2$ and $X_3$ each represents independently a substituted or unsubstituted arylene group, $L_1$ represents a divalent hydrocarbon group which may be branched or may contain a ring structure, and m and n each represents an integer selected from 0 and 1;

(2)

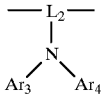

wherein $Ar_3$ and $Ar_4$ each represents independently a substituted or unsubstituted aryl group, and $L_2$ represents a group selected from the group consisting of:

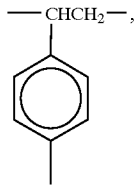

-continued

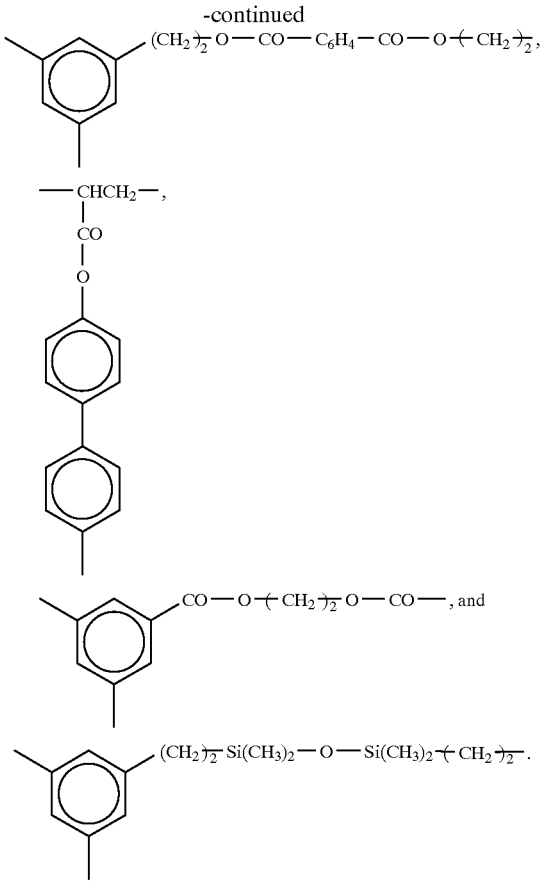

22. An electrophotographic photosensitive member according to claim 10, wherein the charge transporting polymer contains at least one structure represented by Formula 1 or Formula 2 as a repeating unit;

(1)

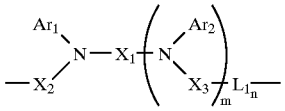

wherein $Ar_1$ and $Ar_2$ each represents independently a substituted or unsubstituted aryl group, $X_1$ represents a divalent hydrocarbon group having an aromatic ring structure, $X_2$ and $X_3$ each represents independently a substituted or unsubstituted arylene group, $L_1$ represents a group selected from the group consisting of:

—$CH_2$—O—$CH_2$—,

—$CH_2$—CO—O—$(CH_2)_2$—,

—$(CH_2)_2$—CO—O—$(CH_2)_2$—O—CO—$(CH_2)_2$—,

—$(CH_2)_2$—CO—O—$C_6H_4$—O—CO—$(CH_2)_2$—,

—$(CH_2)_2$—O—CO—$C_6H_4$—CO—O—$(CH_2)_2$—,

—O—CO—O—$C_6H_4$—$C(CH_3)_2$—$C_6H_4$—O—CO—O—,

—O—CO—O—$(CH_2CH_2O)_2$—CO—O—, and

—$(CH_2)_2$—$Si(CH_3)_2$—O—$Si(CH_3)_2$—$(CH_2)_2$and m and n each represents an integer selected from 0 and 1;

(2)

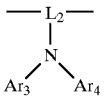

wherein $Ar_3$ and $Ar_4$ each represents independently a substituted or unsubstituted aryl group, and $L_2$ represents a trivalent hydrocarbon group having an aromatic ring structure.

23. An electrophotographic photosensitive member according to claim 1, wherein the second layer is composed of a charge transporting polymer.

24. An electrophotographic photosensitive member according to claim 23, wherein the charge transporting polymer contains at least one compound represented by Formula 1 or Formula 2 as a repeating unit;

(1)

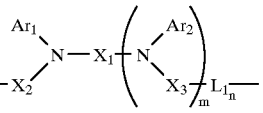

wherein $Ar_1$ and $Ar_2$ each represents independently a substituted or unsubstituted aryl group, $X_1$ represents a divalent hydrocarbon group having an aromatic ring structure, $X_2$ and $X_3$ each represents independently a substituted or unsubstituted arylene group, $L_1$ represents a divalent hydrocarbon group which may be branched or may contain a ring structure, and m and n each represents an integer selected from 0 and 1;

(2)

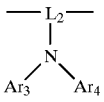

wherein $Ar_3$ and $Ar_4$ each represents independently a substituted or unsubstituted aryl group, and $L_2$ represents a trivalent hydrocarbon group having an aromatic ring structure.

25. An electrophotographic photosensitive member according to claim 1, wherein the charge generation layer contains a phthalocyanine compound as a charge generating material.

26. An electrophotographic apparatus comprising an electrophotographic photosensitive member comprising a charge generation layer and a charge transport layer, on an electroconductive substrate, wherein the charge transport layer comprises a first layer comprising a polymer in a phase separated state with a modulated structure, comprising an electrically inactive phase and a charge transporting phase, and a second layer comprising a charge transporting matrix, wherein an exposure amount required for 50% potential decay is less than 5 times the exposure light amount required for 10% potential decay, and an exposure mechanism carrying out exposure based on digitally processed image signals.

27. An electrophotographic apparatus according to claim 26, wherein the charge generation layer, and the charge transport are adjacent to each other.

28. An electrophotographic apparatus according to claim 27, wherein the charge generating layer, the first layer in the charge transport layer and the second layer in the charge transport layer are layered in that order on the electroconductive substrate.

29. An electrophotographic apparatus according to claim 26, wherein the polymer comprises an admixture of an insulating polymer and a charge transporting polymer.

30. An electrophotographic apparatus according to claim 29, wherein the polymer further comprises: a block copolymer or a graft copolymer having an affinity with both the insulating polymer and the charge transporting polymer, or a polymer having an affinity with either one of the insulating polymer or the charge transporting polymer, and having reactivity to the other.

* * * * *